United States Patent [19]

Pierson

[11] Patent Number: 4,483,252

[45] Date of Patent: Nov. 20, 1984

[54] POWER AND FREE CONVEYOR AND PUSHER ASSEMBLY THEREFOR

[75] Inventor: Robert A. Pierson, Farmington Hills, Mich.

[73] Assignee: Jervis B. Webb Company, Farmington Hills, Mich.

[21] Appl. No.: 425,533

[22] Filed: Sep. 28, 1982

[51] Int. Cl.[3] ..... B61B 10/02

[52] U.S. Cl. ..... 104/172 B; 104/172 S; 198/472

[58] Field of Search ..... 104/89, 94, 172 B, 172 R, 104/172 C, 172 S; 198/472, 473

[56] References Cited

U.S. PATENT DOCUMENTS

| | | | |
|---|---|---|---|
| 3,559,585 | 2/1971 | Lempio | 104/172 S |
| 3,598,228 | 8/1971 | Pipes | 104/172 S X |
| 3,640,226 | 2/1972 | Klamp | 104/96 |

FOREIGN PATENT DOCUMENTS 855879 12/1960 United Kingdom .

1189462 4/1970 United Kingdom .

*Primary Examiner*—Randolph Reese

*Attorney, Agent, or Firm*—Joseph W. Farley

[57] ABSTRACT

A power and free conveyor comprising a power track supporting an endless driven chain to which pusher assemblies are attached, a load track parallel to the power tracks, and carriers mounted on the load track, each carrier having a driving member releasably engageable by a pusher member of a pusher assembly. The conveyor is arranged in a vertical loop having an upright portion in which the power track is above the load track and an inverted portion in which the power track is below the load track. Each pusher assembly includes a pivoted pusher member, a pivoted counterweight member and a one-way connection between these members, the pusher member being biased by its mass into engageable relation with a carrier driving member on the upright portion of the conveyor and being biased into such engageable relation by the mass of the counterweight on the inverted portion of the carrier.

9 Claims, 5 Drawing Figures

POWER AND FREE CONVEYOR AND PUSHER ASSEMBLY THEREFOR

This invention relates to improvements in a power and free conveyor which includes a power track supporting a driven chain, a load track arranged in generally parallel spaced relation to the power track and having a carrier mounted thereon, a pusher member on the chain and a driving member on the carrier. One of the pusher and driving members is movable between an operable position in which it is engageable with the other member and an inoperable position in which it is not so engageable, thereby permitting the carrier to be stopped and any following carrier to accumulate behind the stopped carrier.

The improvements of the invention enable the power and load tracks of the conveyor to include an upright portion in which the power track is disposed above the load track and an inverted portion in which the power track is disposed below the load track. Biasing means normally urges the movable one of the pusher and driving members to the operable position on each of the upright and inverted portions of the power and load tracks, thereby permitting the stopping and accumulation of carriers on both of these portions.

For example, the upright and inverted portions of the power and load tracks of the conveyor may extend horizontally in superimposed vertically spaced relation and be connected by generally vertically extending portions, thus forming a conveyor having the overall configuration of a vertical loop.

In the presently preferred form of the invention to be described, the pusher member is the movable one of the pusher and driving members and forms part of an improved pusher assembly comprising a supporting bracket connected to the chain, a pivot being secured to the bracket and defining a pivotal axis extending transversely to the length of the chain. The pusher member is pivotally mounted on the pivot, has a pusher arm extending radially from the pivotal axis, and is provided with an abutment adapted to engage the carrier driving member. A counterweight member, mounted on the pivot for pivotal movement independently of the pusher member, has a counterweight arm which extends radially from the pivotal axis in a direction generally opposite to the pusher arm and which has a mass in excess of the mass of the pusher arm. One-way connecting means between the pusher and counterweight members enables the pusher member to be biased to the operable position by the mass of its pusher arm on an upright portion of the conveyor tracks and to be biased to the operable position by the mass of the counterweight arm on an inverted portion of the conveyor tracks.

Other features and advantages of the invention will appear from the description to follow of the embodiment thereof disclosed in the accompanying drawings, in which.

Figure 1:
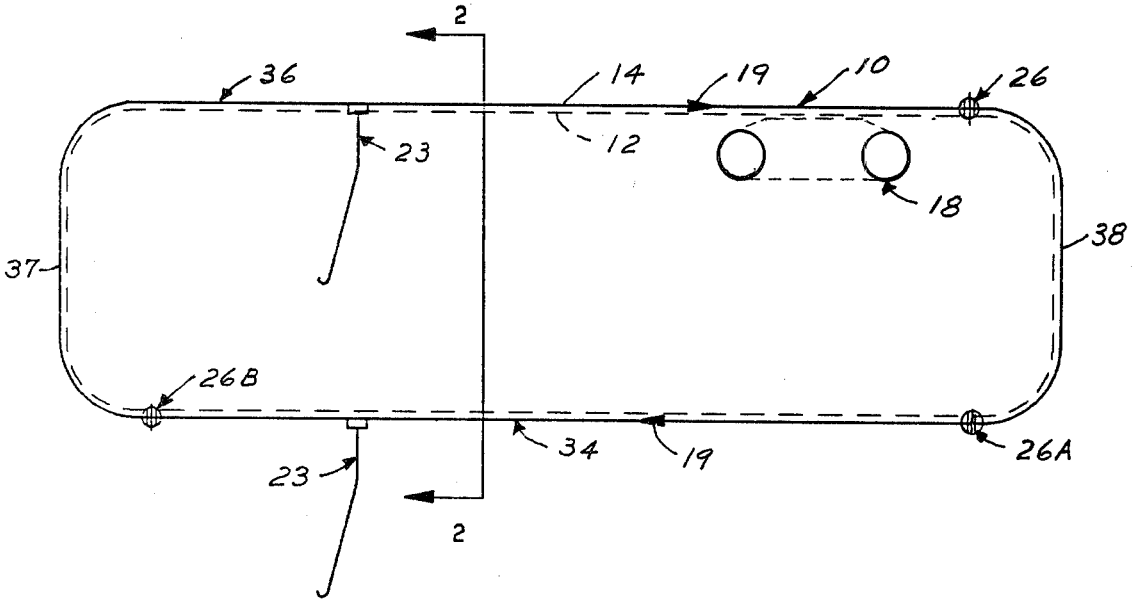
FIG. 1 is a schematic side elevation of a conveyor of the invention.

The representative form of power and free conveyor 10 of the invention schematically illustrated in FIG. 1 includes a power track 12 represented by the broken line and a load track 14 represented by the solid line. An endless chain 16 (FIGS. 3 and 5) is supported by the power track 12, is driven by a drive unit 18 in the direction of the arrows 19, and is equipped with pusher assemblies 20, each having a pusher member 21 and a counterweight member 22. Carriers 23 are mounted on the load track 14, each carrier having a driving member 24 projecting toward the power track 12.

Figure 3:
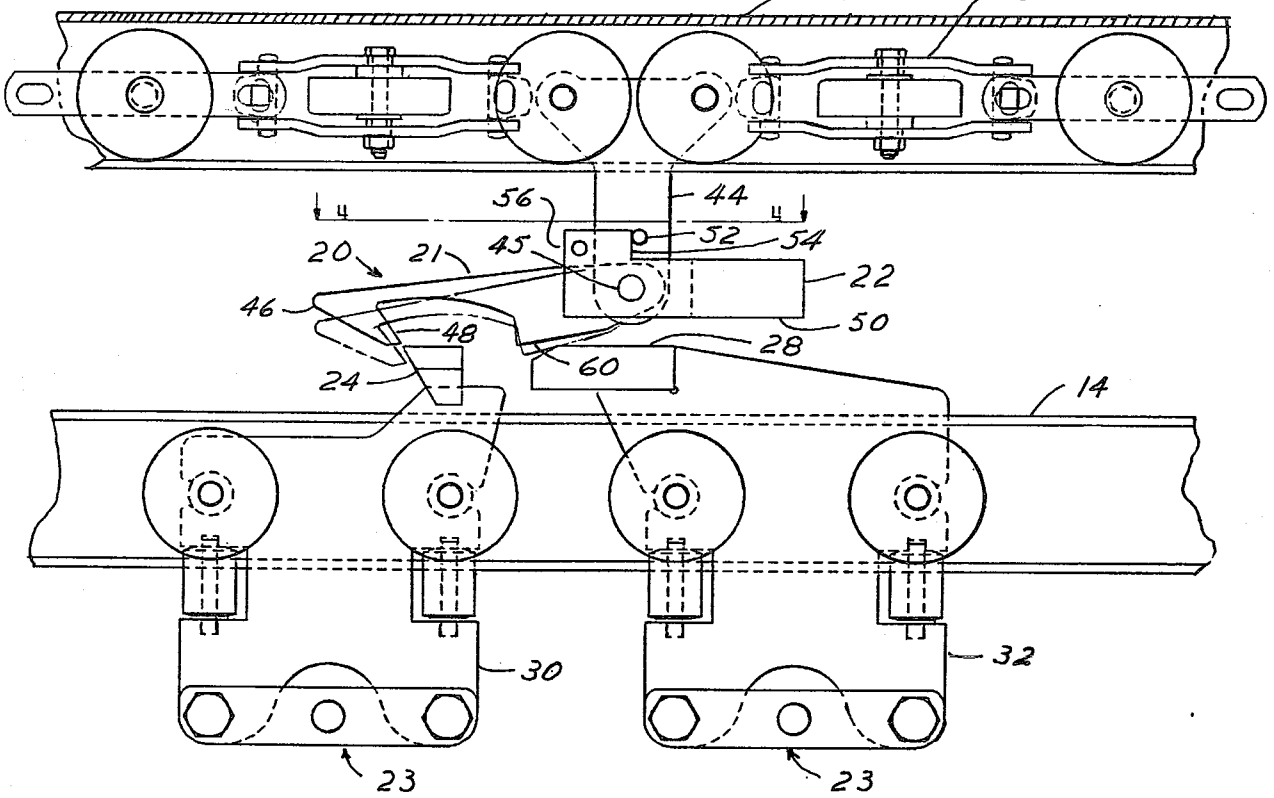
FIG. 3 is an enlarged side elevational detail, taken as indicated by the line 3—3 of FIG. 2, showing details of the load carrying trolleys and a pusher assembly of the conveyor.

One of these pusher and driving members—the pusher member 21 in the construction illustrated—is movable, as indicated in FIG. 3, between an operable position in which it is engageable with the other member and in inoperable position in which it is not so engageable. Movement of the pusher member 21 to the inoperable position results from the action of a stop 26 represented by the circular symbol in FIG. 1, or from the action of a cam 28 (FIG. 3) on the rear of a carrier 23. Reference is made to U.S. Pat. No. 3,559,585 for further details of the construction and operation of the movable pusher member 21, the stop 26 and the cam 28.

Figure 5:
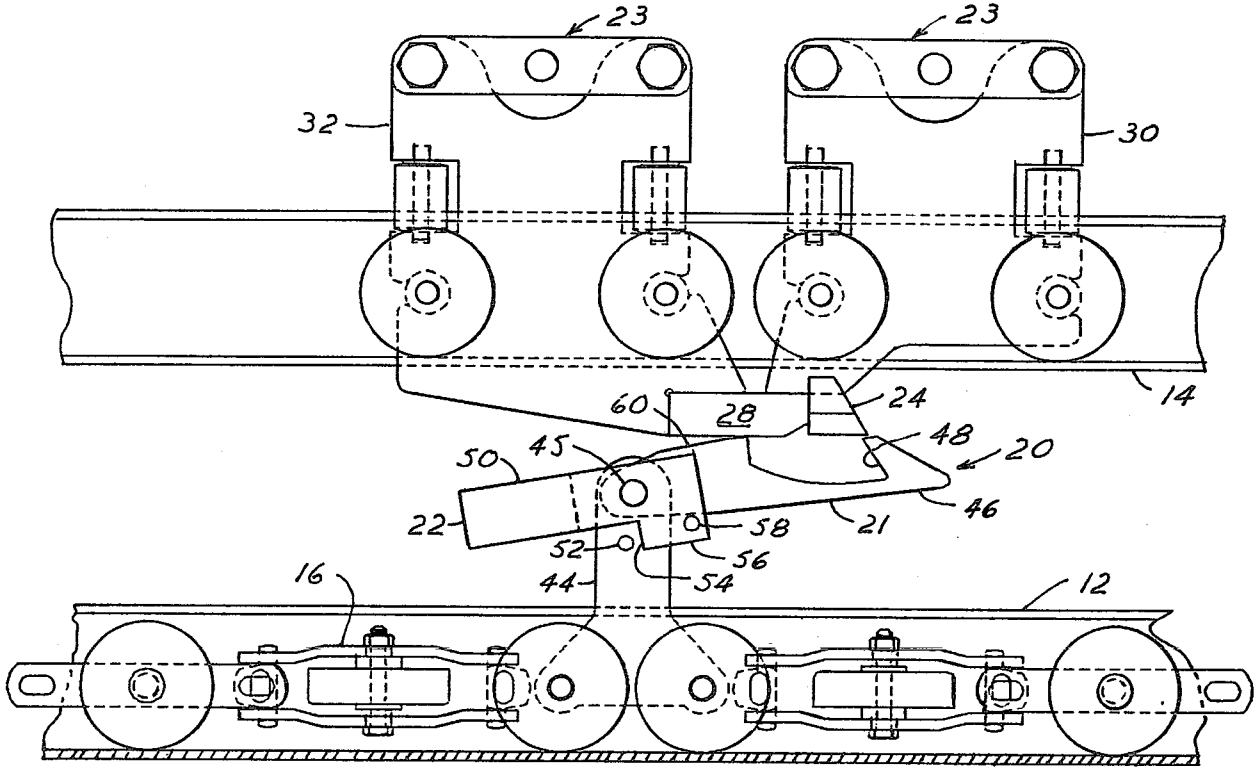
FIG. 5 is an enlarged side elevational detail similar to FIG. 3 but taken as indicated by the line 5—5 of FIG. 2.

FIGS. 3 and 5 illustrate carriers 23 each including a leading trolley 30 equipped with the driving member 24 and a trailing trolley 32 equipped with the cam 28. Other constructional details of the carriers 23 have not been shown since they are not material to the present invention, will vary according to the nature of the articles being conveyed, and are within the capabilities of persons skilled in the art. A carrier may also include only a single trolley equipped with both the driving member 24 and the cam 28, as explained in the above-referenced patent.

Figure 2:
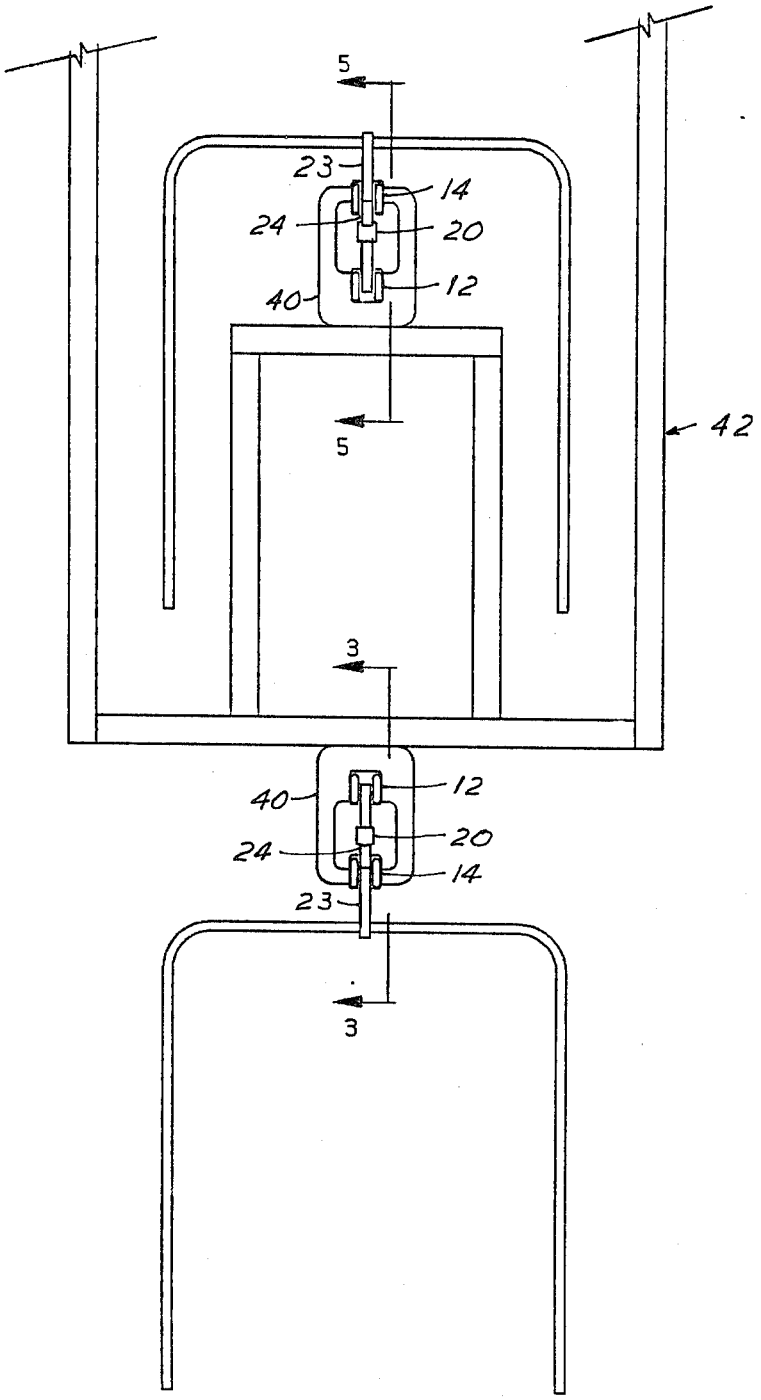
FIG. 2 is an enlarged sectional elevation taken as indicated by the line 2—2 of FIG. 1.

The power and load tracks 12 and 14 of the conveyor 10 shown in FIG. 1 are arranged in a vertically orientated loop formed by a lower horizontally extending portion 34; a superimposed, vertically spaced, upper horizontally extending portion 36; and generally vertically extending connecting portions 37 and 38. Along the lower portion 34, the power track 12 is disposed above the load track 14 in the usual manner and such a track portion is referred to herein as an "upright portion". The upper portion 36 has the power track 12 disposed below the load track 14 and such a track portion is referred to as an "inverted portion". Track yokes 40, FIG. 2, are connected to and position the power and load tracks; these yokes 40 are in turn supported by a suitable suspended framework 42. Biasing means, incorporated in the pusher assembly 20 in the construction illustrated, normally urges the movable pusher member 21 to the operable position on each of the upright and inverted portions of the power and load tracks.

Figure 4:
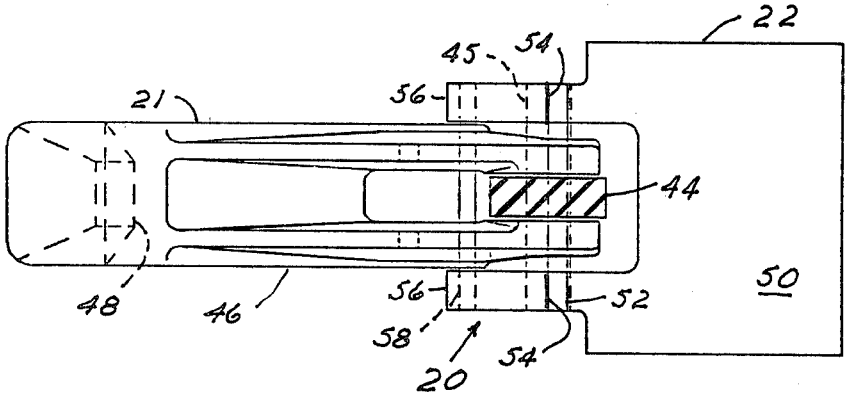
FIG. 4 is a plan view of a pusher assembly taken as indicated by the line 4—4 of FIG. 3.

The pusher assembly 20 and the biasing means will be further described with relation to FIGS. 3—5. Each pusher assembly 20 comprises a supporting bracket 44 connected to the chain 16. A pivot 45 secured to the bracket 44 defines a pivotal axis extending transversely to the length of the chain 16; and, the pusher member 21 and the counterweight member 22 are each pivotally mounted on the pivot 45, the counterweight member 22 being pivotally movable independently of the pusher member 21. The pusher member 21 has a pusher arm 46 which extends radially from the axis of the pivot and is provided with a driving projection 48 adapted to engage the carrier driving member 24, the mass of the pusher arm 46 acting to normally urge the pusher member 21 to the operable position indicated in broken line in FIG. 3 on the upright portion of the power and load tracks shown in this view.

The counterweight member 22 has a counterweight arm 50 which extends radially from the axis of the pivot 45 in a direction generally opposite to the pusher arm 46 and which has a mass in excess of the mass of the pusher arm 46. On the upright portion of the conveyor tracks in FIG. 3, pivotal movement of the counterweight member 22 resulting from the mass of its counterweight arm 50 is limited by a pin 52 carried by the supporting bracket 44. This pin 52 is engaged by abutments 54 formed on each of a pair of positioning arms 56 of the counterweight member 22, the arms 56 extending radially opposite to the counterweight arm 50 and straddling the pusher arm 46, as shown in FIG. 4.

On the inverted portion of the conveyor tracks shown in FIG. 5, a one-way connecting means between the pusher and counterweight members causes the pusher member to be moved by the counterweight member to the operable position, the one-way connecting means comprising a pin 58 extending between the positioning arms 56 and engageable with the pusher arm 46.

The conveyor 10 of the invention can, for example, be used (with a considerable saving in space requirements) to advance carriers 23 from a loading station indicated by the stop 26A at the beginning of the upright portion 34 of the conveyor tracks to one or more unloading stations indicated by the stop 26B. Empty carriers 23 are then forwarded to the inverted portion 36 where they are stopped and accumulated or stored behind the stop 26 for return to the loading station 26A as required. The accumulating action of the pusher assembly 20 is illustrated in each of FIGS. 3 and 5 and results from engagement of a camming portion 60 of the pusher arm 46 with the rearwardly projecting cam 28 of a carrier 23. On the upright position, FIG. 3, this engagement causes the pusher member 21 to pivot upwardly out of operable relation with the driving member 24, the counterweight member 22 being inactive; but on the inverted portion, FIG. 5, the pivotal movement of the pusher member 21 caused by its engagement with the cam 28 is transmitted by the one-way connecting pin 58 to the counterweight member 22 which will then return the pusher member to operable position.

What is claimed is:

1. In a power and free conveyor inclduing a power track supporting a driven chain, a load track arranged in generally parallel spaced relation to the power track and having a carrier mounted thereon, a pusher member on the chain, and a driving member on the carrier, one of the pusher and driving members being mounted on a pivot for movement between an operable position in which the one member is drivingly engageable by the other member and an inoperable position in which the one member is not so engageable, and the power and load tracks include an upright portion in which the power track is disposed above the load track and an inverted portion in which the power track is disposed below the load track; the improvement wherein:

biasing means normally urges the movable one of the pusher and driving members to the operable position on each of the upright and inverted portions of the power and load tracks, the biasing means comprising a part of the movable member extending radially from the pivot and having a mass such as to normally urge the movable member to the operable position on one of the upright and inverted portions of the power and load tracks;

a counterweight is supported on the pivot and is pivotable independently of the movable member, the counterweight including a counterweight arm extending radially from the pivot in a direction generally opposite to said part of the movable member and having a mass in excess of the mass of said part;

and one-way connecting means between the movable member and the counterweight for normally urging the movable member to the operable position by the counterweight on the other of the upright and inverted portions of the power and load tracks.

2. A power and free conveyor according to claim 1 wherein the movable one of the pusher and driving members is the pusher member, and a bracket connected to the chain supports said pivot.

3. A power and free conveyor according to claims 1 or 2 wherein the upright and inverted portions of the power and load tracks are arranged in superimposed vertically spaced relation and are connected by generally vertically extending portions.

4. A power and free conveyor according to claim 3 wherein a carrier stop is provided on each of said upright and inverted portions.

5. A power and free conveyor according to claim 4 wherein the upright portion is spaced vertically below the inverted portion.

6. In a power and free conveyor including a power track supporting a driven chain, a load track arranged in generally parallel spaced relation with the power track, a carrier supported by the load track and having a driving member projecting toward the power track, and a pusher assembly carried by the chain and adapted to releasably engage the driving member, the improvement wherein the pusher assembly comprises:

a supporting bracket connected to the chain;

a pivot secured to the bracket and defining a pivotal axis extending transversely to the length of the chain;

a pusher member pivotally mounted on the pivot and having a pusher arm extending radially from the axis of the pivot, a driving projection on the pusher arm being adapted to engage the carrier driving member;

a counterweight member mounted on the pivot for pivotal movement independently of the pusher member, the counterweight member having a counterweight arm which extends radially from the axis of the pivot in a direction generally opposite to the pusher arm and which has a mass in excess of the mass of the pusher arm; and one-way connecting means between the pusher and counterweight members for causing the pusher member to be moved by the counterweight member to a position in which the driving projection on the pusher arm is engageable with the driving member, the one-way connecting means being operable on an inverted portion of the conveyor wherein the load track is arranged above the power track.

7. A power and free conveyor according to claim 6 wherein the counterweight member includes a positioning arm extending radially oppositely to said counterweight arm and adjacent to the pusher arm of the pusher member, the one-way connecting means comprising an abutment on the positioning arm engageable with the pusher arm.

8. A power and free conveyor according to claim 7 urther comprising motion limiting means carried by the supporting bracket for restricting pivotal movement of the counterweight member.

9. A power and free conveyor according to claims 6 or 8 wherein the counterweight member includes a pair of positioning arms extending radially oppositely to said counterweight arm and straddling the pusher arm of the pusher member, the one-way connecting means comprising a pin extending between the pair of positioning arms and engageable with the pusher arm.

* * * * *